US005829160A

United States Patent [19]

Lange

[11] Patent Number: 5,829,160

[45] Date of Patent: Nov. 3, 1998

[54] APPARATUS FOR GENERATING HEATED AIR

[75] Inventor: Jack Lange, Winnipeg, Canada

[73] Assignee: Jack Lange Holdings Ltd., Winnipeg, Canada

[21] Appl. No.: 652,410

[22] Filed: May 23, 1996

[51] Int. Cl.[6] ..... F26B 17/12

[52] U.S. Cl. ..... 34/168; 34/169; 34/174; 34/233; 34/573; 110/235; 110/346; 432/58; 432/95

[58] Field of Search ..... 34/168, 169, 174, 34/233, 573; 110/235, 241, 344, 346, 347; 432/58, 95

[56] References Cited

U.S. PATENT DOCUMENTS 4,821,428 4/1989 Good ..... 34/86

*Primary Examiner*—Henry A. Bennett
*Assistant Examiner*—Pamela A. Wilson
*Attorney, Agent, or Firm*—Adrian D. Battison; Murray E. Thrift

[57] ABSTRACT

A heater for a grain bin is attached to the inlet flange of a centrifugal inline blower and comprises a housing having a vertical front wall attached to the inlet flange of the blower and a parallel vertical rear wall. The front wall has an opening aligned with the opening into the blower. The rear wall has an opening aligned with the opening in the front wall so that the majority of the air entering the blower passes straight through the housing from the rear wall to the front wall. A sleeve surrounds the opening in the rear wall and induces some flow from the housing to mix with the flow into the blower. The combustion chamber is attached to the rear wall through an opening in the rear wall above the sleeve. The housing has two side walls converging to an open top through which air can escape. When heated air is required an air flow is induced from the combustion chamber to mix with the air flow through the housing to heat the total air flow. In the event that air flow fails, the heat escapes through the open top thus avoiding the necessity for complex interlocks.

13 Claims, 3 Drawing Sheets

APPARATUS FOR GENERATING HEATED AIR

BACKGROUND OF THE INVENTION

This invention relates to an apparatus for generating heated air which is particularly but not exclusively designed for adding heat to an air blower for use in drying grain.

It is often necessary to dry grain stored in a grain bin to prevent excess moisture from causing fermentation and damage to the grain stored.

It is well known therefore that such grain bins contain a duct system extending through the interior of the bin so as to allow air pumped into the duct system to be passed through the grain in the bin to effect a drying process. In general the duct includes a sleeve portion extending with a horizontal axis from one side of the bin to which is attached a cylindrical blower with the axis again horizontal and an inlet end of the blower formed by a circular opening standing in a vertical plane. In some cases drying can be effected simply by movement through the grain of the air, but in other case it is necessary to enhance the drying effect by adding heat to the air. In many cases this heat is only necessary during a part of the cycle or repeatedly during steps of the cycle and generally it is necessary only to raise the temperature of the air by a few degrees since it is necessary to avoid heat damage to the grain.

Conventionally an inline heater is attached to the inlet end of the blower with a propane burner within the heater which adds a controlled amount of heat to the air as it enters the blower. However an arrangement of this type is necessarily relatively complicated in order to provide the necessary safety features and interlocks which prevent excess heat being generated, particularly in a situation where the fan breaks down and therefore does not draw through the system the necessary air to carry away the heat from the burner.

Such complicated heaters are necessarily more expensive and more difficult to maintain.

SUMMARY OF THE INVENTION

It is one object of the present invention, therefore, to provide an improved apparatus for generating heated air which is particularly but not exclusively designed for providing additional heat to air flow for grain drying system in a grain bin.

According to one aspect of the invention there is provided apparatus for generating heated air comprising: a duct for transporting a flow of air to be heated having an air inlet through which air is drawn and an air outlet for emission of the heated air; a fan mounted in the duct for moving air in the duct; and a heater comprising a housing for attachment to the duct, a combustion chamber in the housing including a combustion nozzle for burning a supply gas to heat air in the chamber and guide means in the housing for guiding movement of heated air from the chamber to the duct, said guide means being arranged such that the flow of air through the duct induces said movement of air from the chamber to the duct and such that only a portion of the air flow through the duct is drawn from the chamber, said guide means having a vent opening therein arranged such that, when there is no flow of air passing through the duct, the heated air from the chamber escapes through said vent opening.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
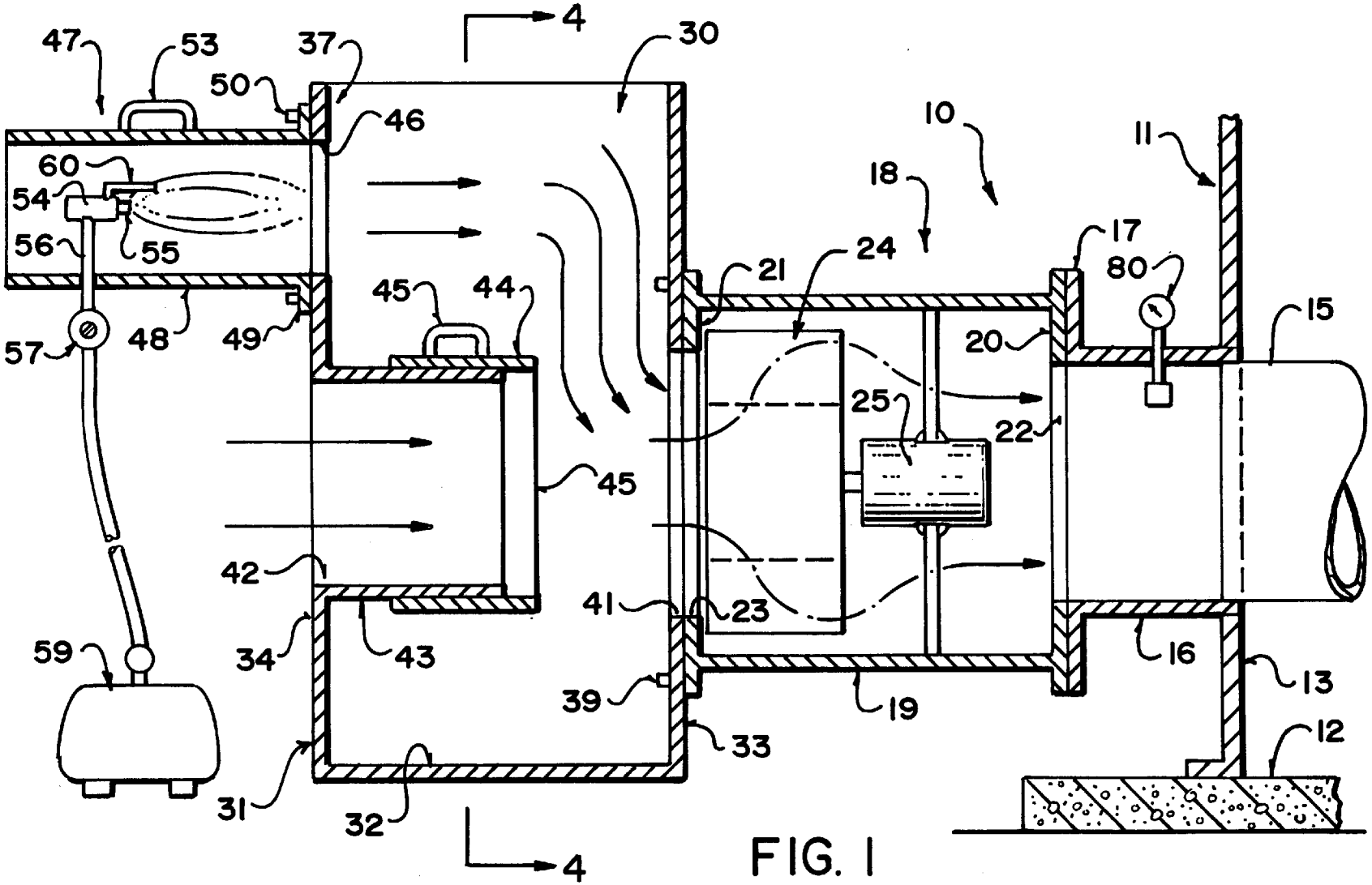
FIG. 1 is a vertical cross sectional view through a heating apparatus according to the present invention.
Figure 2:
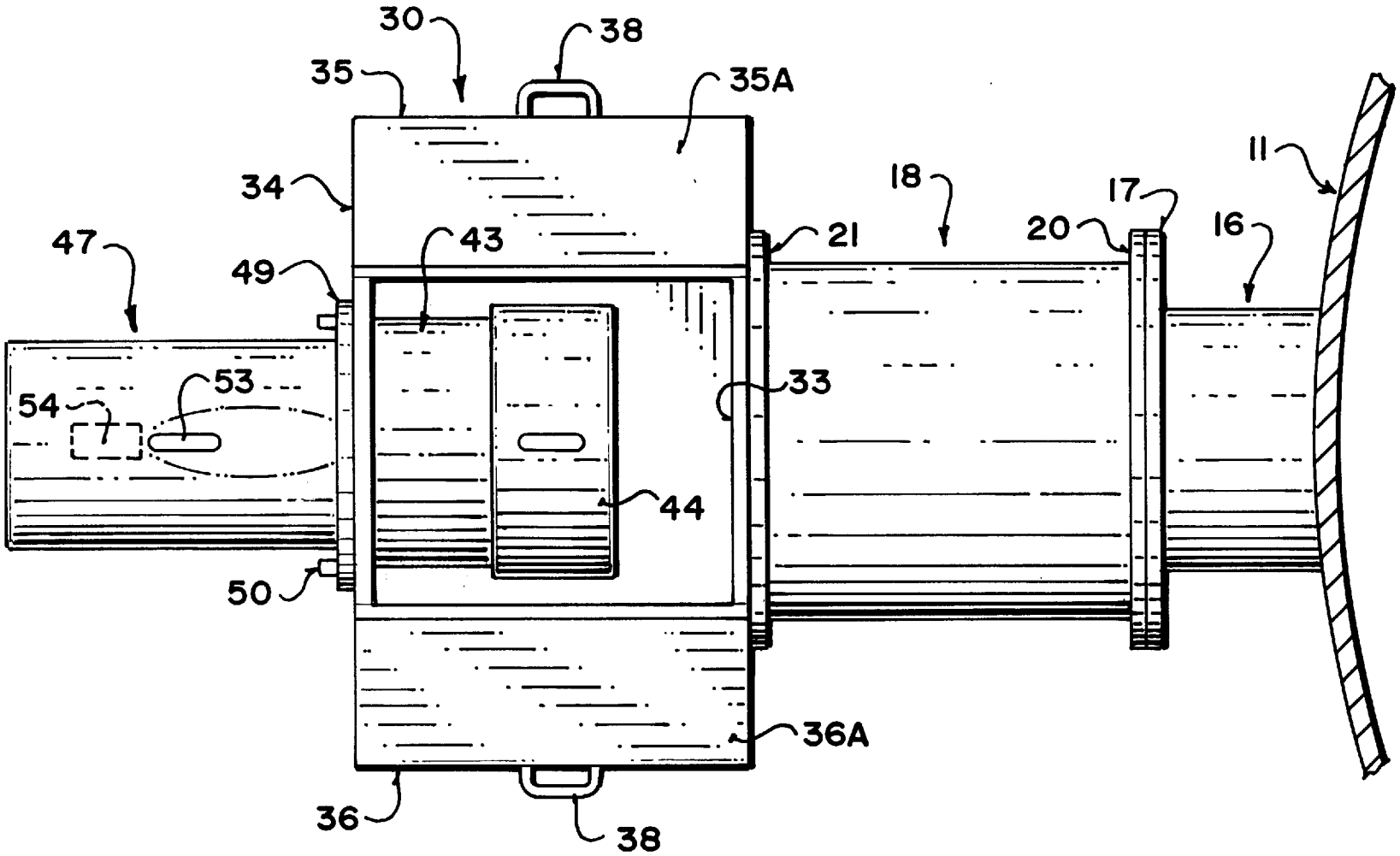
FIG. 2 is a top plan view of the heating apparatus of FIG. 1.
Figure 3:
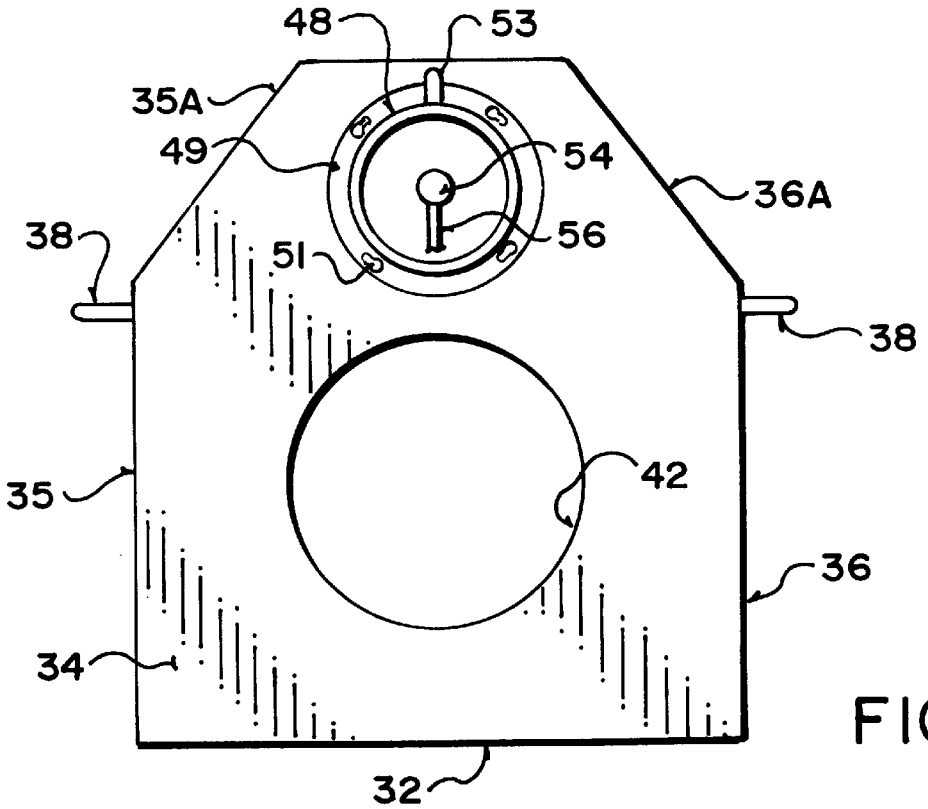
FIG. 3 is a front elevational view of the apparatus of FIG. 1.

A conventional grain bin and dryer system is generally indicated at 10 including a grain bin 11 having a base 12 and upstanding side wall 13. A duct system 15 inside the bin is shown only schematically since this is well known to one skilled in the art and can of course vary significantly depending upon requirements. The duct system communicates with a sleeve 16 on the outside of the wall 13 terminating in a vertical annular flange 17. The flange 17 is attached to a conventional blower 18 which includes a cylindrical housing or duct 19 having an outlet end wall 20 and an inlet end wall 21 which are vertical and parallel to the flange 17. The outlet wall 20 includes an outlet opening 22 communicating with the interior of the sleeve 16 for transmission of air into the duct system. An inlet 23 in the inlet end wall 21 allows air into the interior of the blower for engaging a centrifugal fan element 24 driven by a motor 25 so that air is drawn in through the circular opening 23 in the end plate 21 and driven axially along the sleeve 19 into the sleeve 16.

The blower and duct system therefore forms a single duct with an inlet defined by the inlet plate 21 passing through the blower 18 and the sleeve 16 into the bin.

The apparatus described herein adds a heater element generally indicated at 30 which is of a simple economic construction with very limited parts and no complex interlock control systems so that the heater 30 described herein is suitable for simple attachment and operation in the field.

Figure 4:
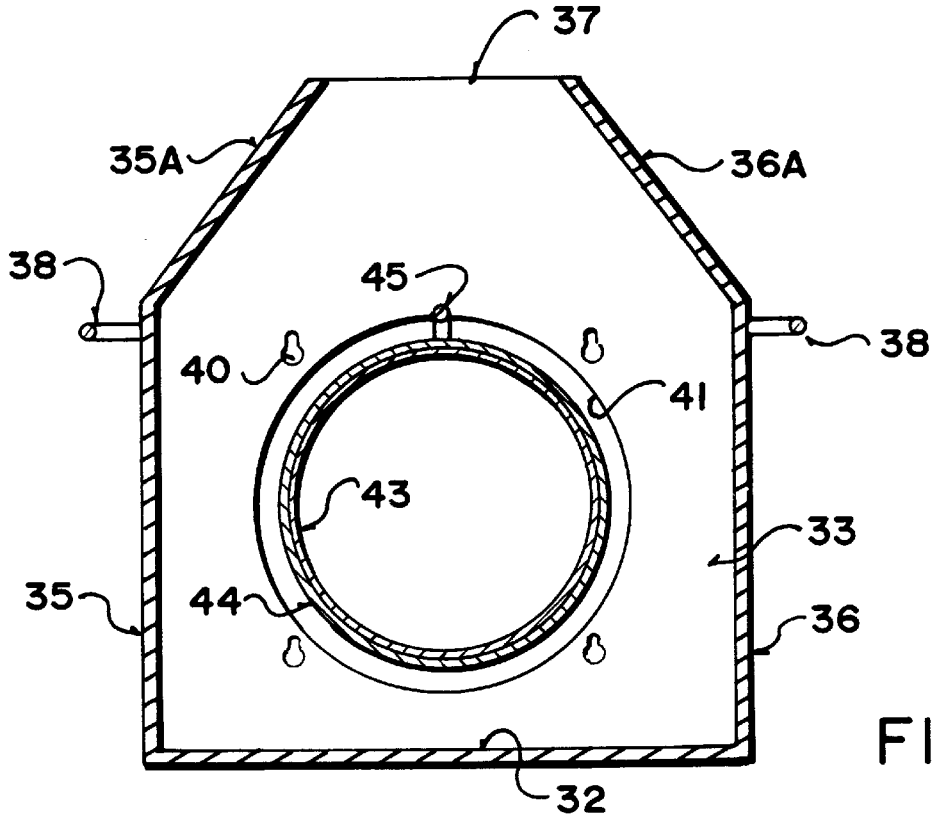
FIG. 4 is a cross sectional view along the lines 4–4 of FIG. 1.

The heating apparatus 30 therefore comprises a housing or a mixing chamber generally indicated at 31 including a base 32, a front upstanding wall 33, a rear upstanding wall 34 and two upstanding side walls 35 and 36. The housing thus forms a generally rectangular container except that the side walls 35 and 36 each include an inwardly inclined upper section 35A, 36A which reduces the width of the housing as best shown in FIG. 4 up to an open top or vent opening 37 defined by termination of each of the upstanding walls in a common horizontal plane at the top of the housing. The housing 31 includes a pair of handles 38 each on a respective one of the side walls 35,36 adjacent the junction with the incline portion. The handles allow the housing to be readily lifted and carried to a required one of the grain bins for effecting heating of the air therein. The heating apparatus 30, which includes the combustion chamber 47 and the heater element 31 is therefore portable and can be readily attached to and removed from grain bins as required.

The attachment system includes a plurality of studs 39 mounted on the exposed face of the end plate 21 of the blower. These studs shown are arranged at the corners of a square and each stud cooperates with a key hole shaped opening 40 in the front wall 33. The mounting operation is therefore very simple in that the stud head passes through the larger part of the key hole opening and the housing is allowed to drop slightly so that the stud neck enters the narrower part of the key hole opening thus supporting the housing on the inlet plate of the blower and preventing its movement away from the blower by the engagement of the stud heads with the inside surface of the front wall 33.

The front wall 33 includes an opening 41 directly aligned with and coextensive with the opening 23 in the inlet plate 21. This allows the inlet air into the blower to be drawn through the housing.

The rear wall 34 which is directly opposite to and parallel with the front wall 33 includes a similar opening 42 substantially aligned with the opening 41 so that air generally is drawn directly through the housing along the axis of the blower. Around the opening 42 is mounted a guide sleeve 43 which is cylindrical in shape and coaxial with the blower so as to guide air entering the opening 42 toward the opening 41 for movement into the blower. The sleeve 43 terminates at a position spaced from the opening 41 and its distance from the opening 41 that is from the front plate 33 can be adjusted by a slide portion 44 again of cylindrical shape surrounding the sleeve 43 and movable manually by a handle 45 in a simple sliding operation. The movement of the slide portion 44 thus adjusts the amount of space between an end face 45A of the guide sleeve and the front wall 33.

The rear wall 34 includes a further opening 46 directly above the opening 42. Attached to the rear wall 34 at the opening 46 is provided a combustion chamber 47 in the form of a simple sleeve 48 having a flange 49 at the end adjacent the wall 34. The flange 49 is attached to the wall 34 by a plurality of studs 50 which cooperate with key hole shaped openings 51 in the flange. The studs are arranged at angularly spaced positions around the opening 46 and similarly the key hole are arranged on the flange at angularly spaced positions around the sleeve 48. The combustion chamber is then attached to the end wall 34 by engaging the studs 50 through the larger part of the keyhole openings and rotating the sleeve 48 until the studs engage into the narrower part of the keyhole openings. The sleeve 48 includes a handle 53 which allows the sleeve to be carried separately from the housing after the ready removal of the combustion chamber 47 defined by the sleeve 48 from the housing.

The combustion chamber includes a simple combustion jet 54 including a nozzle 55 which provides a jet of gas from a supply tube 56 through a valve 57 from a suitable source 59 such as a propane tank available adjacent the bin 11. The valve 57 can therefore adjust the flow rate of the fuel so as to adjust the combustion rate and therefore the amount of heat generated within the sleeve 48 by combustion in the area of the combustion chamber. The only control provided for the combustion nozzle 54 is that of the conventional thermo couple 60 which allows the fuel to be ejected for combustion only in the event that combustion is properly occurring.

In operation, with the field supply turned off at the valve 57, air is normally drawn into the blower through the opening 41 with the majority of the air entering the opening 41 being drawn from the opening 42 and a small proportion of the air being drawn from the housing around the sleeve 43. Thus some of the air is drawn through the combustion chamber 47 and some is drawn through the open top 37 by an induction effect. The apparatus will therefore act normally to allow air flow in the event that no heat is required.

When heat is required, the valve 57 is opened and combustion commenced within the combustion chamber 47. Combustion occurs substantially wholly within the combustion chamber with the jet nozzle being directed toward the opening 46 thus causing a flow of heated air through the combustion chamber which passes through the opening 46 into the housing. In view of the induced air flow from the housing into the opening 41, the air from the combustion chamber is thus induced to flow into the opening 41 and added to the majority of the air passing through the air 42 into the housing. The heated air therefore mixes with the ambient air from the opening 42 and provides a heating of the total air flow through the blower.

A thermometer 80 suitably located in the duct system is used to detect the air temperature and to adjust the valve 57 providing the combustion rate accordingly. The combustion rate can be adjusted from a maximum position providing full flow of the fuel through the valve 57 to a reduced combustion position. However nozzles of this general type require a minimum fuel flow rate of approximately fifty percent to provide proper combustion and therefore it is not possible to reduce the fuel flow below a predetermined minimum. In the event therefore that the temperature rise in the air at the thermometer 80 is to high despite a reduction in the combustion rate, a further reduction can be effected by adjusting the slide portion 44 to reduce the amount of air drawn from the housing and therefore from the combustion chamber into the opening 41. This reduces the proportion of heated air relative to the ambient air passing through the opening 42 and thus reduces the temperature of the total air flow at the thermometer 80.

In such a situation additional heated air enters the housing but rises upwardly due to the tendency of heated air to rise so that the heated air which is excess to that drawn into the opening 41 escapes through the open top 37.

In the event that the blower fails so that the air flow halts, the heated air from the combustion chamber enters the housing through the opening 46 and can therefore simply move upwardly through the open top 37 to escape to atmosphere while tending to draw cooling air through the opening 42. The size of the housing relative to the sizing of the combustion chamber is arranged so that the movement of the heated air through the open top can occur without the possibility of overheating of the housing or the danger of heat damage to or ignition of surrounding materials.

In view of this inherent safety of the device in that the device is wholly safe even in the event of zero air flow, there is no necessity for any complex interlocks which halt the combustion in the event that zero air flow is detected.

The heating device is therefore simple in design without necessity for interlocks and safety features in view of the fact that design is inherently safe and allows the escape of heat naturally in the event of failure.

The device therefore simply comprises the combustion chamber 47 in the form of a simple sleeve and a simple nozzle together with the sheet metal housing which acts to control the air flow. As previously stated the housing and the combustion chamber are readily separable and readily separable from the blower so that they can be readily carried by the handles 38 and 53 from one bin to another.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for generating heated air comprising:

a duct for transporting a flow of air having an air inlet through which air is drawn and an air outlet for emission of the air;

a fan mounted in the duct for moving air in the duct;

and a heater attached to the duct for supplying heated air thereto, the heater comprising:

a combustion chamber including an air inlet, an air outlet and a combustion nozzle for burning a supply gas to heat air passing through the combustion chamber from the air inlet to the air outlet for supply to the duct;

and a mixing chamber attached to the air outlet of the combustion chamber for receiving heated air from the combustion chamber and attached to the duct for supplying the heated air to the duct;

said mixing chamber being arranged to allow the entry therein of unheated air and being arranged such that the flow of air through the duct induces movement of heated air from the combustion chamber to the duct and induces movement of unheated air for mixing with the heated air to the duct such that only a portion of the air flow through the duct is drawn from the combustion chamber;

said mixing chamber including a vent opening therein arranged such that, when there is no flow of air passing through the duct, the heated air from the combustion chamber escapes through said vent opening.

2. The apparatus according to claim 1 wherein the vent opening is arranged at a height above the duct such that the heated air from the combustion chamber rises through the vent opening.

3. The apparatus according to claim 1 wherein the vent opening is free from a closure member so that the vent opening is permanently open to allow the discharge of heated air in the event of failure of the fan.

4. The apparatus according to claim 1 wherein the vent opening comprises an open top of the mixing chamber.

5. The apparatus according to claim 1 wherein the mixing chamber has upstanding walls leading to an open top defining said vent opening, the air outlet of the combustion chamber communicating through one of the upstanding walls.

6. The apparatus according to claim 1 wherein the duct is connected to the mixing chamber at a height below the air outlet of the combustion chamber.

7. The apparatus according to claim 1 wherein said mixing chamber is releasably and readily connectable to the duct and the combustion chamber is releasably and readily connectable to the mixing chamber such that the combustion chamber can be used separately from the mixing chamber and such that the mixing chamber and the combustion chamber can be used with a separate duct.

8. The apparatus according to claim 7 wherein the vent opening comprises an open top of the mixing chamber.

9. The apparatus according to claim 7 wherein the mixing chamber has upstanding walls leading to an open top defining said vent opening, the air outlet of the combustion chamber and the unheated air inlet being connected to a first of the upstanding walls and the duct being connected to a second of the upstanding walls which is opposite to the first of the upstanding walls.

10. The apparatus according to claim 9 wherein the unheated air inlet is opposite to and substantially aligned with the duct.

11. The apparatus according to claim 10 wherein the unheated air inlet includes a guide cylinder surrounding the inlet and extending therefrom toward the duct, the guide cylinder being adjustable in length so as to adjust the proportion of air drawn through the unheated air inlet and through the combustion chamber for mixing in the mixing chamber.

12. Apparatus for generating heated air comprising:

a duct for transporting a flow of air having an air inlet through which air is drawn and an air outlet for emission of the air;

a fan mounted in the duct for moving air in the duct;

and a heater attached to the duct for supplying heated air thereto, the heater comprising;

a combustion chamber including an air inlet, an air outlet and a combustion nozzle for burning a supply gas to heat air passing through the combustion chamber from the air inlet to the air outlet for supply to the duct;

and a mixing chamber attached to the air outlet of the combustion chamber for receiving heated air from the combustion chamber and attached to the duct for supplying the heated air to the duct;

said mixing chamber having an unheated air inlet arranged to allow the entry therein of unheated air and being arranged such that the flow of air through the duct induces movement of heated air from the combustion chamber to the duct and induces movement of unheated air through the unheated air inlet for mixing with the heated air to the duct;

said mixing chamber including a permanently open vent opening therein arranged at a height above the duct, the unheated air inlet and the air outlet of the combustion chamber such that, when there is no flow of air passing through the duct, the heated air from the combustion chamber rises to escape through said vent opening.

13. Apparatus for generating heated air comprising:

a duct for transporting a flow of air having an air inlet through which air is drawn and an air outlet for emission of the air;

a fan mounted in the duct for moving air in the duct;

and a heater attached to the duct for supplying heated air thereto, the heater comprising;

a combustion chamber including an air inlet, an air outlet and a combustion nozzle for burning a supply gas to heat air passing through the combustion chamber from the air inlet to the air outlet for supply to the duct;

and a mixing chamber attached to the air outlet of the combustion chamber for receiving heated air from the combustion chamber and attached to the duct for supplying the heated air to the duct;

said mixing chamber being arranged to allow the entry therein of unheated air and being arranged such that the flow of air through the duct induces movement of heated air from the combustion chamber to the duct and induces movement of unheated air for mixing with the heated air to the duct such that only a portion of the air flow through the duct is drawn from the combustion chamber;

said mixing chamber being releasably and readily connectable to the duct and the combustion chamber being releasably and readily connectable to the mixing chamber such that the combustion chamber can be used separately from the mixing chamber and such that the mixing chamber and the combustion chamber can be used with a separate duct.

* * * * *